United States Patent [19]

Oota et al.

[11] Patent Number: 4,603,847

[45] Date of Patent: Aug. 5, 1986

[54] BANK NOTE PROCESSING MACHINE EQUIPPED WITH A CASSETTE FOR ACCOMMODATING BANK NOTES

[75] Inventors: Koichi Oota; Tsuguo Mizoro, both of Himeji, Japan

[73] Assignee: Glory Kogyo Kabushiki Kaisha, Hyogo, Japan

[21] Appl. No.: 620,209

[22] Filed: Jun. 13, 1984

[30] Foreign Application Priority Data

Jun. 20, 1983 [JP] Japan ..... 58-93339[U]

[51] Int. Cl.[4] ..... B65H 1/02

[52] U.S. Cl. ..... 271/10; 271/119; 271/149; 271/162; 221/151; 221/154

[58] Field of Search ..... 271/10, 149, 150, 162, 271/163, 164, 119, 120, 121, 124, 125, 114, 116; 414/330; 221/152, 153, 154, 209, 217, 218, 197, 198

[56] References Cited

U.S. PATENT DOCUMENTS 4,221,376 9/1980 Handen et al. ..... 271/149

FOREIGN PATENT DOCUMENTS 145735 9/1982 Japan ..... 271/114

*Primary Examiner*—Bruce H. Stoner, Jr.
*Assistant Examiner*—Matthew C. Graham
*Attorney, Agent, or Firm*—Beveridge, DeGrandi & Weilacher

[57] ABSTRACT

A bank note processing machine has at least one cassette in which feed rollers and a gate gap is provided to enable conveying of bank notes. When the cassette is placed outside the machine, the feed rollers are locked. When the cassette is loaded in the main body of the machine, the lock is released. The feed rollers provided in the cassette 2 are driven by one driving system while first and second bank note conveying system in the cassette and the main body are driven by the other driving system.

5 Claims, 9 Drawing Figures

BANK NOTE PROCESSING MACHINE EQUIPPED WITH A CASSETTE FOR ACCOMMODATING BANK NOTES

BACKGROUND OF THE INVENTION

This invention relates to a bank note processing machine such as a bank note dispensing machine, a bank note sorting machine or the like which has therein a cassette or cartridge for accommodating a plurality of bank notes or paper money in line.

A cassette used in a conventional cassette-type bank note processing machine forms a simple box for accommodating many bank notes in line. Such a cassette is disclosed in U.S. Pat. No. 4,158,456. In this Patent, when the cassette is set or loaded in the main body of a bank note processing machine, the foremost bank note in the cassette contacts feed rollers and gate rollers. In this case, when the cassette is taken out from the machine with some bank notes being left in the cassette, the foremost one of the remaining bank notes in the cassette is stopped halfway in a state where the front end of the foremost bank note is held by the gate rollers or two belts forming a bank note conveying path. Therefore, as the cassette is gradually separated from the machine, the foremost bank note in the cassette is left in the machine or is torn off.

Furthermore, there is a problem that the bank notes in the cassette may be discharged therefrom by illicit means the cassette is placed outside the machine. To avoid this, the cassette must be completely locked to cause the cassette to become complicated and heavy.

The problem may be solved, if feed rollers, gate rollers, belts for bank note conveying paths and a drive motor for driving the above rollers and belts are incorporated into the cassette. However, this causes the cassette to become very heavy and difficult to handle. In addition, the electric system associated with the drive motor must be incorporated into the cassette together with the above rollers and belts. The electric system for the motor and some electric parts is apt to have a trouble while the cassette is loaded in or taken out from the machine many times.

SUMMARY OF THE INVENTION

It is an object of this invention to provide a bank note processing machine equipped with a cassette for accommodating bank notes in which any bank note is not left in the machine and not torn off when the cassette is taken out from the machine in spite of relatively simple and light construction.

It is another object of this invention to provide a bank note processing machine in which bank notes in the cassette cannot be discharged therefrom by illicit means when the cassette is placed outside the machine.

According to this invention, there is provided a bank note processing machine in which at least one cassette for accommodating bank notes is detachably loaded, the foremost one of the bank notes in the cassette being dispensed by at least one feed roller having a dispensing portion in an angular range about its axis. The dispensed bank note passes through a gate gap formed by gate means for permitting only one bank note to pass therethrough and is thereafter conveyed by bank note conveying means to the outlet of the machine. The bank note processing machine of the invention comprises: (a) at least one cassette having therein a bank note accommodating portion, at least one feed roller, gate means, first bank note conveying means for receiving a bank note having passed through the gate gap to convey to second bank note conveying means formed in the main body of the machine, a first rotary driven means to which a driving force is transmitted from the main body of the machine to rotate the feed roller and the gate means, a second rotary driven means to which a driving force is transmitted from the main body thereof to drive the first bank note conveying means, and lock means for locking the feed roller when the cassette is not loaded in the main body thereof; (b) first rotary drive means provided on the main body thereof and connected with the first rotary driven means when the cassette is loaded in the main body thereof; (c) second rotary drive means provided on the main body thereof, connected with the second rotary driven means when the cassette is loaded in the main body thereof and controlled independently of the first rotary drive means; and (d) lock release means for releasing the lock means in order to permit the feed roller to rotate when the cassette is loaded in position in the main body thereof.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
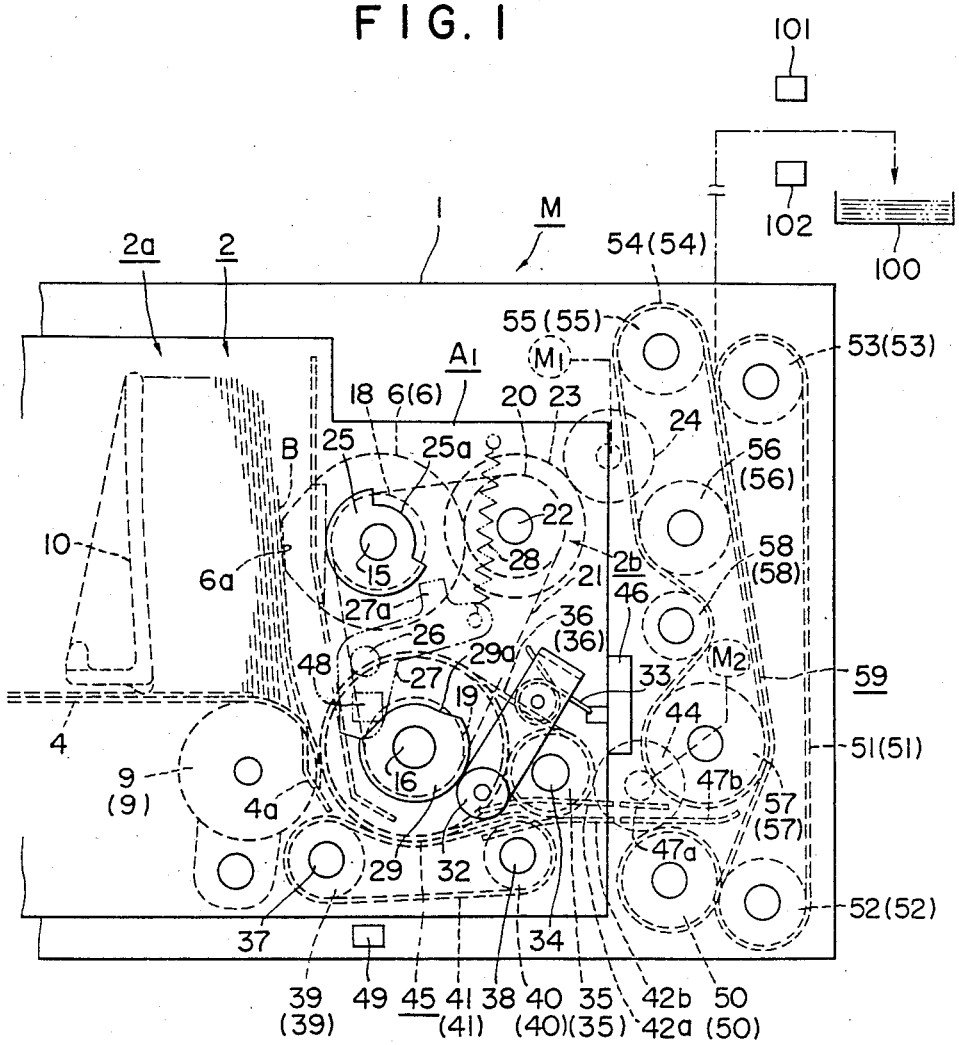
FIG. 1 is a side elevational view of an essential part of a bank note processing machine, according to this invention, in a state wherein a cassette is loaded into the main frame thereof.

In FIG. 1, a bank note dispensing machine M has a main body 1 in which a cassette 2 for accommodating a lot of bank notes in line can be detachably loaded or set.

Figure 2:
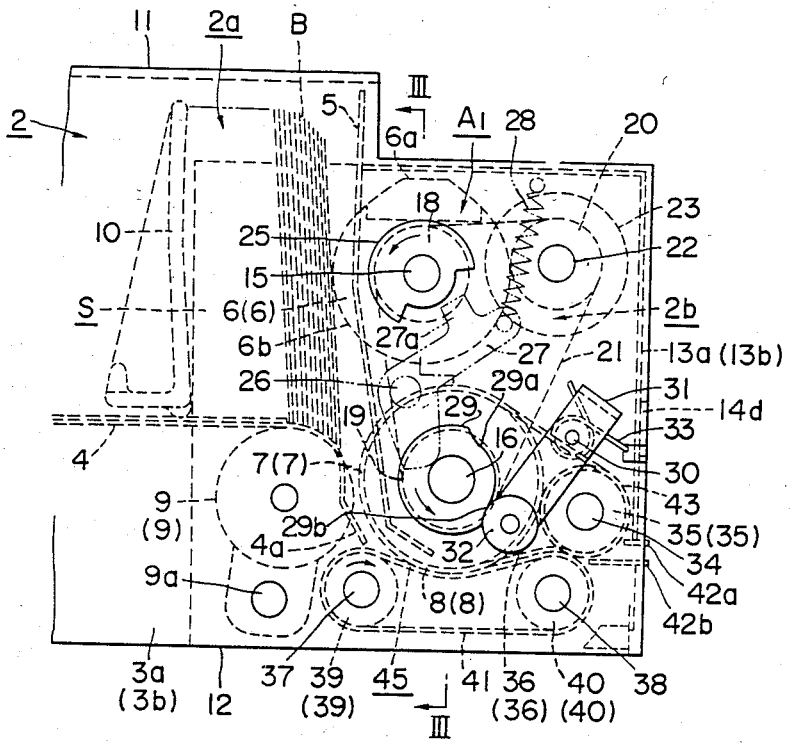
FIG. 2 is a side elevational view of the cassette when it is placed outside the machine.
Figure 3:
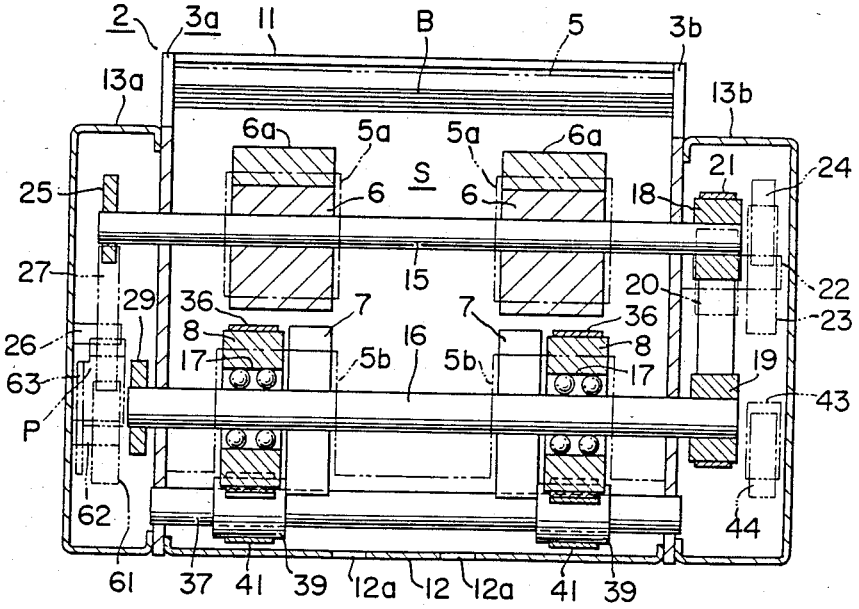
FIG. 3 is a vertically sectional view showing the cassette taken along the line III—III in FIG. 2.

The cassette 2, as shown in FIGS. 2 and 3, has two side plates 3*a*, 3*b* placed apart from each other in the lateral direction of the machine M and a bottom cover plate 12 for closing a space S between the two side plates 3*a*, 3*b*. Most of the space S forms a bank note accommodating portion 2*a* which is defined by the side plates 3*a*, 3*b*, an inner bottom plate 4 located in the middle part of the space S and a front vertical plate 5 placed between the bank note accommodating portion 2*a* and an operating portion 2*b* in which various operating members such as rollers or others are provided. In the middle portion of the front vertical plate 5 are formed two windows 5*a*, 5*a* separated apart in the lateral direction through which two feed rollers 6, 6 fixed to a first shaft 15 are partially projected toward the bank note accommodating portion 2*a*, respectively. Each feed roller 6 has a dispensing portion 6*a* made of elastic and frictional material on its peripheral surface for dispensing a foremost bank note B toward a first bank note conveying path 45 formed in the lower portion of the operating portion 2*b*. The remaining peripheral surface 6*b* exclusive of the dispensing portion 6*a* on each feed roller 6 forms a sliding peripheral surface made of metal.

Under the first shaft 15 is provided a second shaft 16 for fixedly supporting two spaced-apart first gate rollers 7, 7 and two pulleys 8, 8. Each first gate roller 7 and pulley 8 are disposed adjacent to each other in a position corresponding to that of each feed roller 6 in the lateral direction. The peripheries of each first gate roller 7 and pulley 8 are partly projected toward the bank note accommodating portion 2*a* through an opening 5*b* formed in the lower part of the front vertical plate 5.

The front end 4*a* of the inner bottom plate 4 is bent arcuately and downward opposite to the lower part of the front vertical plate 5. In the front end 4*a* of the inner bottom plate 4 are provided two openings (not shown) such as the openings 5*b* formed in the lower part of the front vertical plate 5. Two second gate rollers 9, 9 are partly projected forward through the openings, respectively, so that a gate gap for permitting only one bank note to pass therethrough can be defined between the first and second gate rollers 7, 9. Each of the second gate rollers 9 is opposite to each of the first gate rollers 7 and can be rotated only counterclockwise as viewed in FIGS. 1 and 2. The second gate rollers 9 are rotatably supported by the axis 9*a* so that the gate gap can be adjusted.

On the inner bottom plate 4 is slidably mounted a press plate 10 for urging forward the rear end of the bank notes B accommodated in their upright state in the bank note accommodating portion 2*a*. The bank note accommodating portion 2*a* is covered with an upper openable cover 11 which is opened when the bank notes are charged into the portion 2*a* and which is normally locked.

In FIG. 3, to the side plates 3*a*, 3*b* are respectively fixed two side cover boxes 13*a*, 13*b* with which various members provided outside the side plates 3*a*, 3*b* are covered. The cassette 2 is closed up tighly by the upper cover 11, the side plates 3*a*, 3*b*, the bottom cover plate 12 and the side cover boxes 13*a*, 13*b*.

The first shaft 15 and the second shaft 16 are rotatably supported at their respective ends by the side plates 3*a*, 3*b* and the pulleys 8 are rotatably supported by the second shaft 16 through two bearing means 17, 17, respectively. The respective projecting ends of the first and second shafts 15, 16 on the right side as viewed in FIG. 3 are fixedly provided with two pulleys 18, 19, respectively. In addition, near and parallel to the first shaft 15 is provided a third shaft 22 which has a pulley 20 (FIG. 1) at its right end as viewed in FIG. 3 and a belt 21 runs on the peripheries of the three pulleys 18, 19, 20 so as to form a triangle running path as viewed in FIGS. 1 and 2.

To the right distal end of the third shaft 22 is fixed a first driven pulley 23 as a first rotary driven means which contacts frictionally a first drive pulley 24 connected to a first motor $M_1$ as a first rotary drive means provided on the main frame 1 when the cassette 2 is set or loaded in position. The rotation of the first drive pulley 24 causes the first and second shafts 15, 16 to rotate through the first driven pulley 23, belt 21, and pulleys 18, 19. Accordingly, the feed rollers 6 and gate rollers 7, 7 are rotated.

The left distal end of the first shaft 15 in the left side cover 13*a*, as viewed in FIG. 3, is fixedly provided with a cam plate 25 having a cut recess portion 25*a* at its periphery. The cut recess portion 25*a* is formed in an angular range about the first shaft 15 in which the dispensing portion 6*a* of the feed roller 6 is not located.

To the inner vertical wall of the left side box 13*a* is fixed a supporting axis 26 for swingably supporting a stop lever 27. This stop lever 27 has a stop projection 27*a* for engaging with the cut recess portion 25*a* of the cam plate 25 and is urged by a coil spring 28 in the counterclockwise direction in the drawings.

To the left distal end of the second shaft 16 is fixed a cam plate 29, having a cut recess portion 29*a* at its periphery, against which a cam follower 32 abuts. The cam follower 32 is supported, at its lower end, by a lever 31 which is supported by a supporting axis 30 fixed to the side plate 3*a* and which is urged, by a torsion coil spring 33, in the clockwise direction as viewed in FIGS. 1 and 2.

A fourth shaft 34 is rotatably supported by the side plates 3*a*, 3*b* parallel and close to the second shaft 16 and has two pulleys 35, 35 thereon, each of which is in the position corresponding to each pulley 8 on the second shaft 16 in the lateral direction. Two belts 36 and 36 are disposed between the pulleys 8, 35 and 8, 35, respectively.

Furthermore, two parallel shafts 37, 38 are disposed between the two side plates 3*a*, 3*b*. The shaft 37 has two pulleys 39, 39 and the shaft 38 has two pulleys 40, 40. The pulleys 38, 39 are in their respective positions corresponding to those of the pulleys 8 in the lateral direction. Each belt 41 is disposed between the pulleys 39, 40. In front of the pulleys 35, 40 are disposed two guide plates 42*a*, 42*b* spaced apart in the vertical direction in order to guide the bank notes B.

The right distal end of the fourth shaft 34 in the right side cover box 13*b* is fixedly provided a second driven roller 43 as a second rotary driven means which contacts frictionally a second drive roller 44 connected to a second motor $M_2$ as a second rotary drive means supported on the main body 1. Accordingly, the rotation of the second drive roller 44 causes the pulleys 8 to rotate through the second driven roller 43, the pulleys 35 and the belts 36. Moreover, the belts 36 contact frictionally the belts 41 so as to rotate the pulleys 39, 40 and their respective parallel shafts 37, 38.

The above pulleys 8, 35, 39, 40, belts 36, 41 and guide plates 42*a*, 42*b* form a first bank note conveying means for feeding the bank notes B from the foremost end of the bank note accommodating portion 2*a* to the inside of the main body 1.

The first drive roller 24 and second drive roller 44 are rotated by two separated drive motors $M_1$, $M_2$, respectively. The rotational relationship between the drive rollers 24 and 44 is so controlled that the peripheral speed of the feed rollers 6 is slower than the running speed of the belts 36, 41 in order to prevent the bank notes B flipped out by the feed rollers 6 from jamming in the first conveying path 45.

To prevent the bank notes B having been dispensed from being left, midway the conveying path 45, without being discharged outside the cassette 2, the belts 36, 41 are adapted to be stopped in a few seconds after the feed rollers 6 are stopped. That is, the second drive roller 44 is stopped after the first drive roller 24 is stopped. This timing operation is carried out by a plurality of sensors provided along bank note conveying paths in the machine for detecting the existence of the bank notes B. The drive rollers 24, 44 may be rotated by one drive motor (not shown). In this case, the diameters of the two drive rollers 24, 44 are so determined that the running speed of the belts 36, 41 is faster than the peripheral speed of the feed rollers 6 and the rotation of either the roller 24 or the roller 44 is controlled by a clutch mechanism (not shown) provided between the motor and either the roller 24 or the roller 44.

On the inner wall of the main body 1 are fixedly provided two guide plates 47*a*, 47*b* which are in alignment with the guide plates 42*a*, 42*b*, respectively, and sensing means comprising a light emitting element 48 and a light receiving element 49 (FIG. 1). The light emitting element 48 is adapted to pass through an opening 14*d* formed on the front plate 14 (FIG. 2) of the cassette 2 thereby to be inserted into a position over the first bank note conveying path 45. The light receiving element 49 is fixed to the main body 1 in a position opposite to that of the light emitting element 48. Furthermore, an opening 12*a* is formed in the bottom cover plate 12 of the cassette 2 to permit light emitted from the light emitting element 48 to reach the light receiving element 49. Furthermore, the front plate 14 has two openings (not shown) at its lower and upper portions to permit the drive rollers 24, 44 to enter partly the cassette 2.

Under the guide plates 47*b* are provided two spaced-apart roller 50, 50 one of which contacts frictionally the second drive roller 44 and rotates two driven rollers 52, 52. Two driven rollers 53, 53 are provided in an upper position opposite to that of the driven rollers 52 and two belts 51, 51 run between the two pairs of rollers 52, 53, respectively. The inner running portion of the each belt 51 abuts against the outer running portion of each of two belts 54, 54 which run around driven pulleys 55, 55, 56, 56, 57, 57. The tension of each belt 54 is adjusted by each of two tension pulleys 58, 58. The belts 51, 54 are rotated by the second drive roller 44 through the pulleys 50, 52, 53, 54, 56, 57 at the same speed to form a second vertical bank note conveying path 59. The belts 51, 54 and pulleys 50, 52, 53, 54, 56, 57 form a second bank note conveying means.

In the above embodiment, when the cassette 2 is not loaded in position, i.e., it is taken out from the main body 1, the stop projection 27*a* of the stop lever 27 abuts against the cut recess portion 25*a* of the cam plate 25 thereby to prevent the feed rollers 6 from being rotated by a person who inserts his fingers through the opening of the front plate 14 for the drive roller 24 to rotate the first driven roller 23. In addition, the engagement of the stop projection 27*a* with the cut recess portion 25*a* can also prevent the feed rollers 6 from being unexpectedly rotated when vibrations are imparted to the cassette 2.

Moreover, the cam plate 29 fixed to the second shaft 16 functions to stop the feed rollers 6 in a position where its dispensing portion 6*a* does not contact the foremost bank note B, as shown in FIG. 2, when the first drive roller 24 stops. That is, when the first drive roller 24 stops, the feeding rollers 6 are apt to continue rotating because of their momentum and there is a possibility that the feed rollers 6 stop with its dispensing portion 6*a* contacting the foremost bank note B. With this state, if the feed rollers 6 are rotated, the foremost bank note B cannot be fully fed into the first bank note conveying path 45 thereby to cause jamming of bank notes B therein. However, in this invention, when the feed rollers 6 are rotated because of their momentum, the cam plate 29 is also rotated in accordance with the rotation of the feed rollers 6 because of connection between the pulleys 18, 19 through the belt 21. At this time, the cam plate 29 rotates in a state where its periphery contacts the cam follower 32. During one rotation of the cam plate 29 about the axis of the second shaft 16, the cam follower 32 drops into the recess portion 29*a*. Thereafter, when the back end 29*b* of the portion 29*a* in the rotating direction of the cam plate 29 contacts the cam follower 32, the cam plate 29 is stopped by being pressed by the cam follower 32. This state is shown in FIG. 2. This causes the feed rollers 6 to stop in an angular position where its dispensing portion 6*a* does not contact the foremost bank note B, for example, as shown in FIG. 2.

When the first drive roller 24 stops, the second drive roller 44 still continues to drive in order to run the belts 36, 41 because a bank note B flipped out by the feed rollers 6 should be completely discharged from the inside of the cassette 2 to the outlet 100 of the machine M. At this time, the rotation of the pulleys 8 is apt to promote rotation of the second shaft 16 by its momentum. The engagement of the cam plate 29 with the cam follower 32 also functions to refrain the second shaft 16 from rotating because of its momentum. The relationship between the depth of the cut recess portion 29*a* of the cam plate 29 and the spring force of the torsion spring 33 is so adjusted that the cam follower 32 can permit the cam plate 29 to rotate smoothly during the normal rotation of the feed rollers 6 and however the cam follower 32 can function to refrain the cam plate 29 from rotating because of its momentum.

Furthermore, when the cassette 2 is taken out from the main body 1, the feed rollers 6 must be stopped in a state where the projection 27*a* of the stop lever 27 engages with the cut recess portion 25*a* of the cam plate 25. For this purpose, the two cam plates 25, 29 are respectively fixed to the first and second shafts 15, 16 in such a positional relationship that the projection 27*a* faces the cut recess portion 25*a* when the cam follower 32 engages with the cut recess portion 29*a*.

In addition, as shown in FIG. 1, on the inner wall of the main body 1 is fixedly provided a stop plate 46 for engaging with the front end of the cassette 2. When the cassette 2 is stopped by the stop plate 46 in the state where its front end abuts against the stop plate 46, the cassette 2 is set regularly in the main body 1 and is thereafter locked by a lock mechanism which is not shown in the drawings.

The above cam plates 25, 29 stop lever 27, cam follower 32 and lever 31 form lock means $A_1$.

The details of lock release means $A_2$ for releasing the lock means $A_1$ will now be explained with reference to FIGS. 4A to 4D.

A release bar 60 is fixed to the stop plate 46 so as to extend horizontally. At the left end of the release bar is formed a rack 60*b* for engaging with a pinion 61 rotatably provided in the cassette 2. The release bar 60 is adapted to be inserted into the cassette 2 through the opening 14*a* formed on the front plate 14 and its left distal end 60*a* as viewed in FIGS. 4A to 4D functions to release the feed rollers from the stop lever 27 (see FIG. 4C).

The opening 14*a* is defined by two members 14*b*, 14*c* located apart from each other in the vertical direction. The two members 14*b*, 14*c* respectively have two inclined surfaces 14*b*' 14*c*' which expand toward the outside of the cassette 2 to lead easily the distal end 60*a* of the release bar 60 into the opening 14*a*. The two inclined surfaces 14*b*', 14*c*' are respectively connected with two horizontal surfaces 14*b*'', 14*c*'' and their connecting points function as mentioned hereinafter when a false member such as a driver is inserted into the opening 14*a*.

The pinion 61 is fixedly supported by an axis 62 rotatably provided on the inner wall of the left side cover box 13*a*. The axis 62 is provided with a shutter lever 63 as shutter means which has an L-shaped shutter plate P at its end. This shutter plate P has a shutter portion 63*a* which is partly fixed to the shutter lever 63, a middle portion 63*b* thereof extending perpendicular to the shutter portion 63*a* thereof, and a stop portion 63*c* thereof extending in a short length from the middle portion 63*b* thereof. The axis 62 is urged by an extension coil spring 64 in the clockwise direction so that the stop portion 63*c* abuts against a stopper pin 65 fixed to the inner end of the member 14*b* (FIG. 4A).

The shutter portion 63*a* of the shutter plate P functions to prevent the false release bar C (FIG. 4D) such as a driver from reaching the tail 27*b* of the stop lever 27. Furthermore, the middle portion 63*b* of the shutter plate P functions to prevent the shutter lever 63 from being rotated by the false release bar C while cooperating with the inner ends of the inclined surfaces 14*b*', 14*c*' and one of the teeth of the pinion 61. That is, when the false release bar C is intensionally inserted into the cassette 2 through the opening 14*a*, the distal end of the false release bar C abuts against the shutter portion 63*a* thereby to rotate it slightly counterclockwise as viewed in FIG. 4D. However, the movement of the false release bar C is limited by three points X (the inner end of the inclined surface 14*b*'), Y(one tooth of the pinion 61) and Z (the middle portion 63*b* of the shutter plate), thus the shutter lever 63 not being rotated counterclockwise any more. This prevents the stop lever 27 from being rotated by the false release bar C when the cassette 2 is taken out from the inside of the main body 1.

Figure 4A:
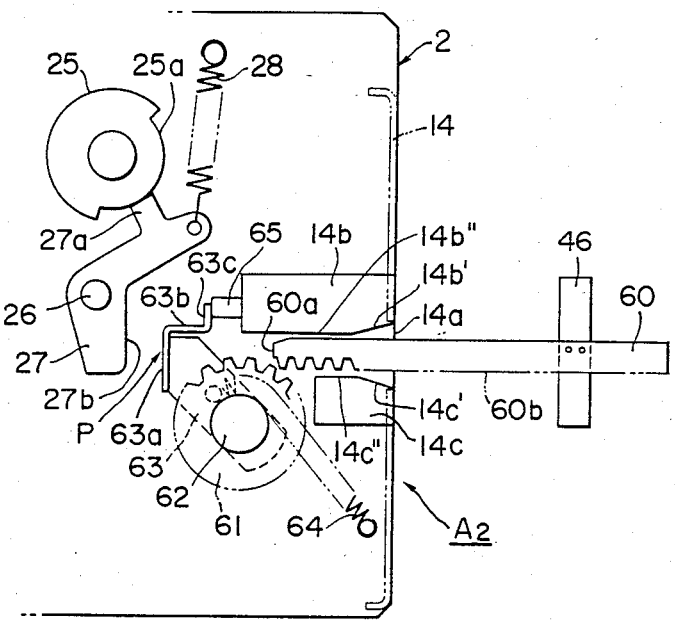
FIGS. 4A to 4D are side elevational views showing a lock release means, FIG. 4A showing a first stage for releasing a lock means, FIG. 4B showing a second stage for releasing the lock means, FIG. 4C showing a third stage for releasing the lock means, and FIG. 4D showing a state wherein a false release member such as a driver is inserted into the cassette.
Figure 4B:
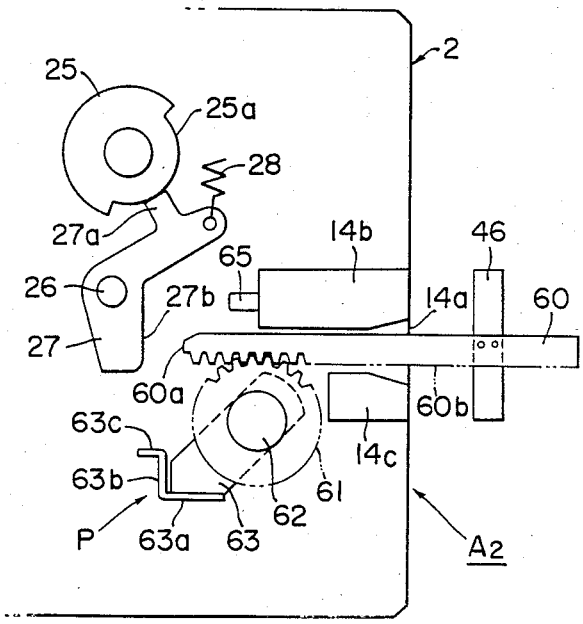

When the cassette 2 is loaded into the main body 1 at a first stage, the release bar 60 is inserted into a space between the above two members 14*b*, 14*c* through the opening 14*b* as shown in FIG. 4A. When the cassette 2 is more deeply inserted into the main body 1 at a second stage, the rack 60*b* of the release bar 60 begins to engage with the teeth of the pinion 61 to rotate the pinion 61 counterclockwise as shown in FIG. 4B. In accordance with the counterclockwise rotation of the pinion 61, the shutter lever 63 rotates in the same direction to open the path for the release bar 60 through which its distal end 60*a* reaches the tail 27*b* of the stop lever 27.

Figure 4C:
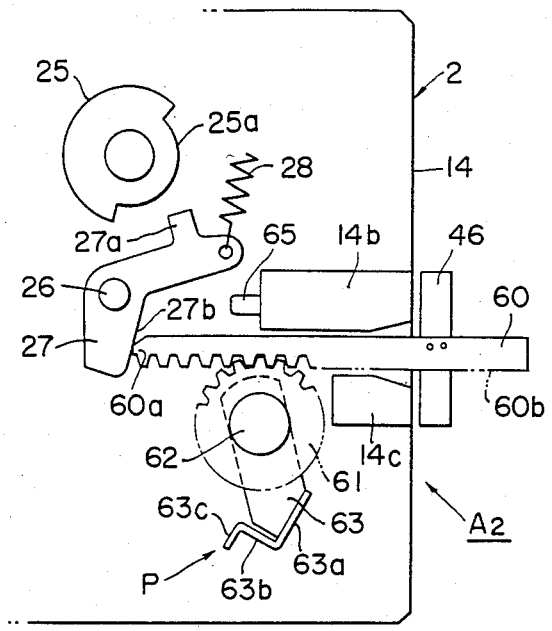
Figure 4D:
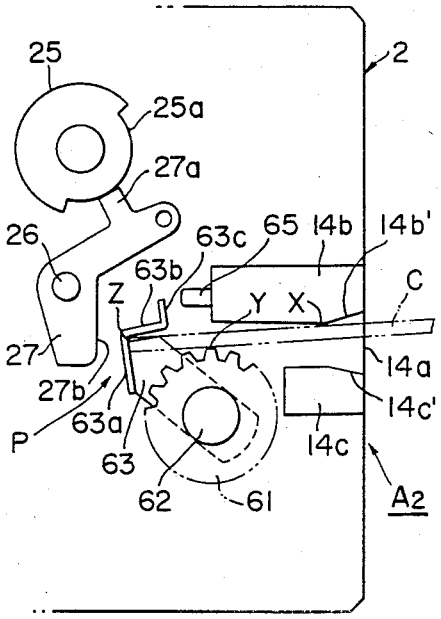

When the cassette 2 is loaded in a position where the front plate 14 of the cassette 2 almost abuts against the stop plate 46, the distal end 60*a* of the release lever 60 begins to push the tail 27*b* of the stop lever 27 in the clockwise direction against the spring force of the coil spring 28 thereby to cause the projection 27*a* to separate from the cut recess portion 25*a* as shown in FIG. 4C.

When the cassette 2 is set in position as shown in FIG. 1, the front plate 14 of the cassette 2 completely abuts against the stop plate 46. At this time, the first driven roller 23 and second driven roller 43 in the cassette 2 abut against the first drive roller 24 and the second drive roller 44, respectively.

With this state, if a start button (not shown) is pushed, the feed rollers 6 begin to feed the foremost bank note B into the first bank note travelling path 45.

When the cassette 2 is taken out from the main body 1, the front plate 14 is separated away from the stop plate 46. At this time, the first and second driven rollers 23, 43 are also separated away from the first and second drive rollers 24, 44. When the cassette 2 is further taken out from the main body 1, the above members are placed in their respective positions shown in FIG. 4B through those positions shown in FIG. 4C. That is, the distal end 60*a* releases the stop lever 27 so as to be rotated in the counterclockwise direction by the spring force of the coil spring 28. Accordingly, the projection 27*a* of the stop lever 27 abuts against the cut recess portion 25*a* of the cam plate 25 thereby to limit the rotation of the feeding rollers 6 to an angular range corresponding to the arcuate length of the cut recess portion 25*a*.

As the cassette 2 goes far away from the stop plate 46, the pinion 61 gradually rotates clockwise until the stop portion 63*c* of the shutter plate P engages with the stopper pin 65 as shown in FIG. 4A.

The operation of this bank note processing machine will now be explained.

A group of bank notes B are charged into the accommodating portion 2*a* of the cassette 2 with the upper openable cover 11 opened by operation of a lock key. Thereafter, the cassette 2 is inserted into the main body 1 until the front plate 14 of the cassette 2 abuts against the stop plate 46 and the cassette 2 is then locked by the lock mechanism (not shown) in the main body 1. As the cassette 2 approaches the stop plate 46, the light emitting element 48 and the release bar 60 are inserted into the inside of the cassette 2 through the openings 14*d*, 14*a* respectively, and the release bar 60 rotates the pinion 61 to open the path for the release bar 60, so that the distal end 60*a* of the release bar 60 pushes the tail 27*b* of the stop lever 27 so as to release the cam plate 25 (FIG. 4C).

When the cassette 2 is set in a state where the front plate 14 of the cassette 2 abuts against the stop plate 46, the first and second drive rollers 24, 44 are partly inserted into the front portion of the cassette 2 thereby to contact the first and second driven rollers 23, 43, respectively. At this time, the light emitting element 48 is located above the inlet of the first bank note conveying path 45 and the light receiving element 49 is located under the inlet of the first bank note conveying path 45.

When a signal for feeding out the bank notes B is transmitted to the drive motors $M_1$, $M_2$, the first and second drive rollers 24, 44 begin to rotate whereby the feed rollers 6, gate rollers 7 and the belts 36, 41 also begin to rotate. The feed rollers 6 and the gate rollers 7 are rotated at the same circumferential speed, and the belts 36, 41 rotate at a speed slightly faster than that of the feeding rollers 6 and the gate rollers 7. The belts 51, 54 also rotate at the same speed as that of the belts 36, 41.

The feed rollers 6 rotate counterclockwise as viewed in FIG. 1 to flip downward the foremost bank note B. The gate rollers 7, 9 permit only one bank note B to pass through the gate gap formed therebetween. The bank note B flipped by the rollers 6 is then held between the two belts 36, 41. At this time, the light emitting element 48 and the light receiving element 49 detect the existence of the bank note B to transmit a signal to a counter (not shown). Thereafter, the bank note B passes through the second conveying path 59 to reach the outlet 100 of the bank note dispensing machine M.

Thus, when the liqht emitting and receiving elements 48, 49 detect a predetermined number of the bank notes B, the first drive roller 24 is stopped. At this time, the feed rollers 6 and gate rollers 7 still continue to rotate by their inertia until they are stopped by the cam plate 29 and the cam follower 32 in their respective positions shown in FIG. 2. That is, each feed roller 6 is stopped in a position where its dispensing portion 6*a* does not contact the foremost bank note B while the cam follower 32 engages with the cut recess portion 29*a* of the cam plate 29. However, at this stage, the projection 27*a* of the stop lever 27 faces the cut recess portion 25*a* of the cam plate 25 in a position away therefrom without contacting the cut recess portion 25*a*.

After the feed rollers 6 are stopped, the belts 36, 41 still continue to rotate for a few seconds to send the last bank note B to the outlet 100 of the bank note dispensing machine M. Two sensors 101, 102 are provided close to the outlet 100 thereof. When the sensors 101, 102 detect the last bank note B, the motor $M_2$ is stopped thereby to stop the belts 36, 41, 51, 54.

When the cassette 2 is taken out from the main body 1 for charging the bank notes B into the cassette 2, the release lever 60 is separated away from the stop lever 27 to cause the stop lever 27 to rotate counterclockwise as viewed in FIG. 1. Accordingly, at this time the projection 27*a* of the stop lever 27 engages with the surface of the cut recess portion 25*a* of the cam plate 25 thereby to restrain the feed rollers 6 from rotating. Therefore, it is avoidable that the remaining bank notes B in the cassette 2 are discharged therefrom by illicit means.

Figure 6:
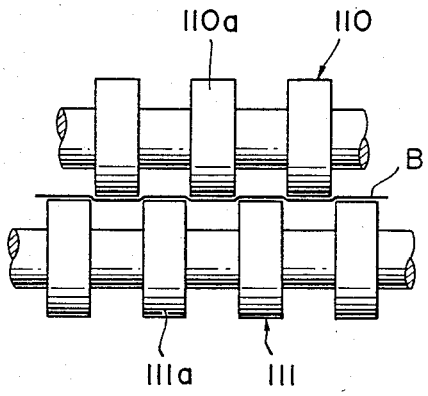
FIG. 6 is a plan view showing another embodiment of gate means.

In the above embodiment, there are provided two feed rollers 6. However, the number of feed rollers 6 can be freely determined in accordance with the size of bank notes B. Furthermore, the gate gap which is formed by the roller-type gate rollers 7, 9 in the above embodiment can be replaced by plate-type gate means (not shown). In addition, the gate gap may be formed by two gate rollers 110, 111 which have, respectively, a plurality of rings 110*a*, 111*a* disposed zigzag as shown in FIG. 6. The first conveying path 45 is formed by the belts 36, 41. However, instead of the belts 36, 41, a group of rollers may be used. The first and second drive rollers 24, 44 contact frictionally the rollers 43, 50, respectively. However, instead of these rollers, some gears may be used.

Figure 5:
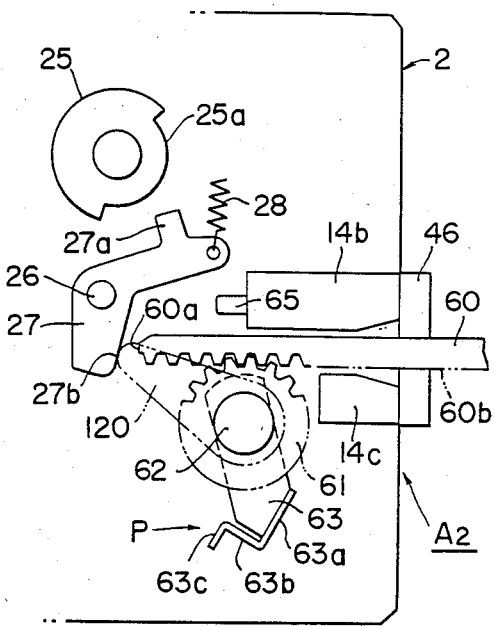
FIG. 5 is a side elevational view showing another embodiment of a lock releasing means.

FIG. 5 shows another embodiment of a lock releasing mechanism. In this case, the axis 62 of the pinion 61 is fixedly provided with a release lever 120 for releasing the stop lever 27. That is, the release bar 60 does not release the stop lever directly, but release it via the release lever 27 indirectly.

As stated above, in this invention, the first and second drive rollers 24, 44 are provided on the main body 1 while the first and second driven rollers 23, 43 are provided, opposite to the first and second drive rollers 24, 44, in the cassette 2. The first drive roller 24 functions to drive the feed rollers 6 and gate rollers 7 while the second drive roller 44 functions to drive the belts 36, 41. Furthermore, the first and second drive rollers 24, 44 are controlled independently of each other. In this manner, as the driving system for the feed rollers 6 and the gate rollers 7 is separated from that for the belts 36, 41, the belts 36, 41, 51, 54 for the first and second conveying paths 45, 59 can still continue conveying the last bank note B to the outlet 100 of the machine M after the feed rollers 6 and gate rollers 7 are stopped when a predetermined number of the bank notes B are dispensed by the feed rollers 6. Accordingly, there is no fear that the last bank note B dispensed by the feed rollers 6 is left in the main body 1 when the cassette 2 is taken out from the main body 1.

In addition, as the lock means comprising the stop lever 27, the cam plates 25, 29 and the cam follower 32 can prevent the feed rollers 6 from rotating when the cassette 2 is placed outside the machine M, the bank notes B left in the cassette 2 cannot be discharged by illicit means.

What is claimed is:

1. A bank note processing machine in which at least one cassette for accommodating bank notes is detachably loaded, the foremost one of the bank notes in the cassette being fed out one by one by feeding means provided in the cassette, the fed out band note being thereafter conveyed by bank note conveying means to the outlet of the machine, which comprises:

(a) at least one cassette having therein a bank note accommodating portion, at least one feed roller, having a dispensing portion in an angular range about its axis, gate means for forming a gate gap for permitting one bank note to pass therethrough, a first bank note conveying means for receiving a bank note having passed through the gate gap to convey to a second bank note conveying means formed in the main body of the machine, a first driven rotary means to which a driving force is transmitted from the main body of the machine to rotate the feed roller and the gate means, a second driven rotary means to which a driving force is transmitted from the main body thereof to drive the first bank note conveying means, and lock means for locking the feed roller responsive to the cassette being detached from the main body of the machine;

(b) first rotary drive means provided on the main body thereof and connected with the first rotary driven means when the cassette is loaded in the main body thereof;

(c) second rotary drive means provided on the main body thereof, connected with the second driven rotary means when the cassette is loaded in the main body thereof and controlled independently of the first rotary drive means; and (d) lock release means for releasing the lock means in order to permitting the feed roller to rotate when the cassette is loaded in position in the main body thereof.

2. A bank note processing machine according to claim 1, wherein the first rotary drive means and the second rotary drive means are connected to two different drive motors, respectively.

3. A bank note processing machine according to claim 1, wherein the lock means comprises: a first cam plate provided with a cut recess portion in an angular range about its axis and fixed to a first shaft to which the feed roller is fixed, the dispensing portion of the feed roller being formed in an angular range different from that of the cut recess portion thereof; a stop lever provided swingably near the first cam plate for locking the first cam plate and releasing same, cooperating with a lock release bar; a second cam plate provided with a cut recess portion and fixed to the second shaft to which the gate means is fixed; and a cam follower urged toward the periphery of the second cam plate, an angular positional relationship between the first and second cam plates being so determined that a stop projection of the stop lever faces the cut recess portion of the first cam plate when the cam follower engages with the cut recess portion of the second cam plate, the first and second shaft being rotated at the same time.

4. A bank note processing machine according to claim 3, wherein the lock release means comprises a release bar fixed to the main body so as to be inserted into the cassette for rotating the stop lever.

5. A bank note processing machine according to claim 4 wherein the lock release means further comprises a pinion fixed to an rotary axis for engaging with the teeth of the release bar, and a shutter plate connected to the rotary axis for closing a path through which the release bar is to be passed when the release bar is not inserted into the cassette.

* * * * *